US010499140B2

(12) United States Patent
Gong et al.

(10) Patent No.: US 10,499,140 B2
(45) Date of Patent: Dec. 3, 2019

(54) SPEAKER AND HEADPHONE

(71) Applicant: SHENZHEN GRANDSUN ELECTRONIC CO., LTD., Shenzhen, Guangdong (CN)

(72) Inventors: Weiyong Gong, Shenzhen (CN); Haiquan Wu, Shenzhen (CN); Ruiwen Shi, Shenzhen (CN)

(73) Assignee: SHENZHEN GRADSUN ELECTRONIC CO., LTD., Shenzhen, Guangdong (CN)

( * ) Notice: Subject to any disclaimer, the term of this patent is extended or adjusted under 35 U.S.C. 154(b) by 0 days.

(21) Appl. No.: 16/102,454

(22) Filed: Aug. 13, 2018

(65) Prior Publication Data

US 2018/0367885 A1 Dec. 20, 2018

Related U.S. Application Data

(63) Continuation-in-part of application No. PCT/CN2017/078177, filed on Mar. 24, 2017.

(30) Foreign Application Priority Data

Oct. 31, 2016 (CN) ..... 2016 1 0977818

(51) Int. Cl.
*H04R 9/02* (2006.01)
*H04R 1/10* (2006.01)

(52) U.S. Cl.
CPC ..... *H04R 1/1091* (2013.01); *H04R 9/025* (2013.01); *H04R 2400/11* (2013.01)

(58) Field of Classification Search
CPC ..... H04R 1/1091; H04R 1/20; H04R 9/025; H04R 9/06; H04R 2209/024; H04R 2400/11

(Continued)

(56) References Cited

U.S. PATENT DOCUMENTS

2002/0127976 A1 9/2002 Liu
2004/0208338 A1* 10/2004 Pan ..... H04R 9/06 381/412

(Continued)

FOREIGN PATENT DOCUMENTS

CN 2323545 Y 6/1999
CN 20461583 U 9/2015

(Continued)

OTHER PUBLICATIONS

PCT International Search Report; Application No. PCT/CN2017/078177; dated Jul. 18, 2017; 6 pages.

(Continued)

*Primary Examiner* — Norman Yu
(74) *Attorney, Agent, or Firm* — Conley Rose, P.C.; Grant Rodolph

(57) ABSTRACT

An apparatus includes a horn bracket, a magnet system and a vibration system, where the horn bracket includes a through hole configured for positioning the magnet system, the magnet system includes an inner magnetic ring and an outer magnetic ring sleeved on an exterior of the inner magnetic ring, the inner magnetic ring is coaxial with the outer magnetic ring, a gap is provided between an inner annular surface of the outer magnetic ring and an outer annular surface of the inner magnetic ring, where the inner annular surface and the outer annular surface have opposite magnetic polarities, magnetic flux lines formed in the gap by the outer magnetic ring and the inner magnetic ring are radially disposed, the vibration system includes a voice diaphragm, a voice coil having one end coupled to the voice diaphragm, and a winding coupled to the other end of the voice coil.

20 Claims, 4 Drawing Sheets

(58) Field of Classification Search
USPC ..... 381/340, 303–309, 322, 71.7, 74, 335, 381/93, 117, 342, 345, 182, 370–372, 381/374, 185–186, 190, 400–402, 412
See application file for complete search history.

(56) References Cited

U.S. PATENT DOCUMENTS

| | | | | |
|---|---|---|---|---|
| 2007/0140522 | A1* | 6/2007 | Stewart | H04R 9/022 381/421 |
| 2008/0170710 | A1* | 7/2008 | Pasternak | H04R 1/2849 381/74 |
| 2015/0172820 | A1* | 6/2015 | Hunstable | H04R 9/02 381/401 |
| 2015/0350765 | A1* | 12/2015 | David | H04R 1/1075 381/74 |

FOREIGN PATENT DOCUMENTS

| | | | |
|---|---|---|---|
| CN | 104902406 | A | 9/2015 |
| CN | 106375915 | A | 2/2017 |

OTHER PUBLICATIONS

PCT Written Opinion of the International Searching Authority; Application No. PCT/CN2017/078177; dated Jul. 18, 2017; 4 pages.

* cited by examiner

SPEAKER AND HEADPHONE

CROSS REFERENCE TO RELATED APPLICATIONS

This is a continuation-in-part of International Patent Application No. PCT/CN2017/078177 filed on Mar. 24, 2017, which claims priority to Chinese Patent Application No. 201610977818.8 filed on Oct. 31, 2016, both of which are hereby incorporated by reference as if reproduced in their entirety.

TECHNICAL FIELD

The present application relates to the technical field of electronic products, and in particularly, to a speaker and a headphone.

BACKGROUND

With the constant improvement of living standards, people are under increasing pressure from work and life, and music has become an effective way of alleviating stress. With the continuous upgrading of the headphone, the sound quality of the headphone is also stricter.

The speaker is the sound element of the headphone, and the key design of the control sound in the speaker is the design of the magnetic circuit. At present, most of the magnetic circuit structures are internal magnetic structures, the distribution of magnetic lines is uneven and asymmetrical, and the sound emitted by the speaker is seriously distorted, which reduces the user experience of the headphone.

SUMMARY

One object of the present application is to provide a speaker and a headphone which can overcome the problem of uneven and asymmetrical distribution of magnetic lines and distortion of the emitted sound.

In order to solve the above technical problem, a technical solution adopted by the present application is to provide a speaker, which comprises a horn bracket, a magnet system and a vibration system, wherein, the horn bracket is provided with a through hole configured for positioning the magnet system. The magnet system comprises an inner magnetic ring and an outer magnetic ring sleeved on an exterior of the inner magnetic ring, the inner magnetic ring is coaxial with the outer magnetic ring, a gap is provided between an inner annular surface of the outer magnetic ring and an outer annular surface of the inner magnetic ring, wherein the inner annular surface and the outer annular surface have opposite magnetic polarities, and magnetic flux lines formed in the gap by the outer magnetic ring and the inner magnetic ring are radially disposed. The vibration system comprises a voice diaphragm, a voice coil and a winding, the voice diaphragm and the winding are respectively disposed at two ends of the voice coil, the winding is disposed in the gap, and the voice diaphragm is connected to an end of the horn bracket.

Further, the outer magnetic ring comprises a plurality of end-to-end outer magnetic components, each of the outer magnetic components has a first inner magnetic end facing towards the ring center and a first outer magnetic end facing away from the ring center, and the inner magnetic ring comprises a plurality of end-to-end inner magnetic components, each of the inner magnetic components is provided with a second inner magnetic end facing towards the ring center and a second outer magnetic end facing away from the ring center, the first inner magnetic end and the second outer magnetic end have opposite magnetic polarities.

Further, if the number of the outer magnetic components is N, and the number of the inner magnetic components is M, then N=M, and the N outer magnetic components and the M inner magnetic components are arranged in a one-to-one correspondence.

Further, each of the outer magnetic components and each of the inner magnetic components have a fan-shaped or rectangular cross-section, or alternatively each of the outer magnetic components and each of the inner magnetic components are in a columnar shape.

Further, the magnet system further comprises a magnetic shield assembly, the magnetic shield assembly comprises a first magnetic shield assembly disposed on one side of the inner magnetic ring and the outer magnetic ring and directly opposite to the voice diaphragm, and a second magnetic shield assembly disposed on the other side of the inner magnetic ring and the outer magnetic ring. The first magnetic shield assembly comprises a first inner magnetic member in an annular shape and fixed to one side of the inner magnetic ring, and a first outer magnetic member sleeved on the exterior of the first inner magnetic member and fixed to one side of the outer magnetic ring, and both the side face of the first outer magnetic member and the side face of the first inner magnetic member, facing towards the voice diaphragm, have opposite magnetic polarities and form a closed first annular magnetic circuit therebetween. The second magnetic shield assembly comprises a second inner magnetic member in an annular shape and fixed to the other side of the inner magnetic ring, and a second outer magnetic member sleeved on the exterior of the second inner magnetic member and fixed to the other side of the outer magnetic ring, and both the side face of the second inner magnetic member and the side face of the second outer magnetic member, facing away from the voice diaphragm, have opposite magnetic polarities and form a closed second annular magnetic circuit therebetween.

Further, side faces of the first inner magnetic member and of the second inner magnetic member, facing the inner magnetic ring, have the same magnetic polarity as the outer annular surface of the inner magnetic ring, and side faces of the first outer magnetic member and of the second outer magnetic member, facing the outer magnetic ring, have the same magnetic polarity as the inner annular surface of the outer magnetic ring.

Further, the horn bracket is provided in a wall of the through hole with a stop ring configured for limiting the displacement of the first outer magnetic member toward the voice diaphragm, the stop ring is located at a port of the through hole that is facing towards the voice diaphragm.

Further, the horn bracket further comprises a U-shaped cup, which is fixed to an end of the horn bracket facing away from the voice diaphragm, the U-shaped cup is provided with an open cavity, a base wall of the open cavity is provided with a perforation in communication with the through hole, and the second inner magnetic member and the second outer magnetic member are fixed to the base wall of the open cavity.

Further, the base wall of the open cavity is located at the outer edge of the perforation and surrounds the perforation, and is provided with a stopping cylinder protruding toward the voice diaphragm, wherein the outer sidewall of the stopping cylinder, the base wall and a side wall of the open cavity together form an annular groove with a U-shaped cross section, and the magnet system is fixed within the annular groove.

Further, the base wall of the open cavity is provided with an annular stop protruding toward the gap, and the second outer magnetic member and the second inner magnetic member are respectively disposed on both sides of the annular stop.

Further, the horn bracket is provided with an annular connection cylinder protruding toward the U-shaped cup, the annular connection cylinder is arranged on an end surface of the horn bracket which is directly facing towards the U-shaped cup and surrounding an edge of an end opening of the through hole, and an end surface of the annular connection cylinder and an end surface of an open end of the U-shaped cup are butted by an ultrasonic welding process.

Further, the horn bracket further comprises a damp ring with an opening, the horn bracket is provided in a surface facing away from the voice diaphragm with an annular accommodation groove configured for accommodating the damp ring, and a bottom wall of the annular accommodation groove faces the damp ring and is provided with a plurality of apertures toward the voice diaphragm.

Further, the horn bracket further comprises a circuit board connected with the output line of an audio device, the winding is connected with the circuit board to realize the transmission of the audio signal, the annular accommodation groove is provided with two barrier strips protruding from the bottom wall facing the opening of the damp ring, and the circuit board is fixed between the two barrier strips.

Further, the horn bracket is provided with an accommodation groove recessed in an end surface facing the voice diaphragm, the accommodation groove is provided with an annular step at a junction of a groove bottom and a groove wall thereof, and an outer edge of the voice diaphragm is fixed on the stepped surface of the annular step.

The present application further provides a headphone, comprising a housing, a speaker according to the foregoing speaker which is disposed in the housing, and a connection wire configured for connection with an audio device and transmission of an audio signal, wherein the connection wire is in electrical connection with the winding.

The technical effect of the present application over other approaches is that radial magnetic flux lines are formed in the gap between the inner magnetic ring and the outer magnetic ring by radially magnetizing the inner magnetic ring and the outer magnetic ring under the action of the magnetizing device. The inner annular surface of the outer magnetic ring and the outer annular surface of the inner magnetic ring have opposite magnetic polarities. The outer annular surface of the inner magnetic ring and the inner annular surface of the outer magnetic ring are parallel to each other and parallel to the axis. As such, uniform and symmetrical radial magnetic flux lines are formed in the gap; that is, an annular radial magnetic field is formed. One end of the voice coil is fixedly connected to the voice diaphragm, another end of the voice coil is connected to the winding, the winding receives the audio signal transmitted from the audio device, and the winding is inserted into the gap, an electromagnetic induction is generated by varying signals input through the winding and the uniform and symmetrical radial magnetic field in the gap. According to the principle of the left-hand rule, a drive force with different amplitudes and along the axis will be generated and driving the vibration system reciprocates linear motion, which will convert electrical audio signals into sound signals. The speaker is normally applied to the headphone, but not limited to the headphone. The inner magnetic ring and the outer magnetic ring are magnetized by radial magnetization of the inner magnetic ring and the outer magnetic ring, and uniform and symmetrical radial magnetic flux lines are formed in the gap such that the voice coil is only subjected to an axial force, driving the voice diaphragm into vibration. The design of the magnet system reduces leakage and hysteresis losses, ensures uniform and symmetrical distribution of magnetic flux lines, reduces distortion, and realizes reproduction of true sound.

Figure 1:
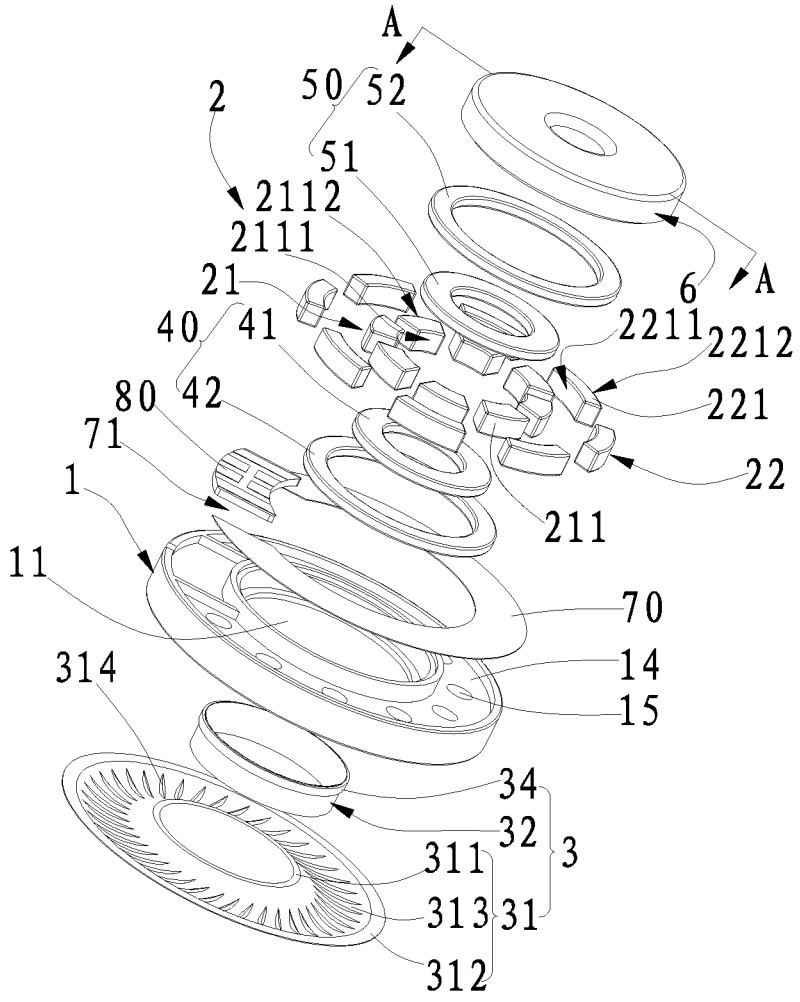
FIG. 1 is an exploded perspective view of a miniature speaker according to one embodiment of the present application.

The reference numerals of the drawings are listed as follows:

| | | | |
|---|---|---|---|
| horn bracket | 1 | magnet system | 2 |
| vibration system | 3 | U-shaped cup | 6 |
| through hole | 11 | inner magnetic ring | 21 |
| outer magnetic ring | 22 | voice diaphragm | 31 |
| voice coil | 32 | winding | 34 |
| gap | 33 | inner ring diaphragm | 311 |
| outer ring diaphragm | 312 | middle ring diaphragm | 313 |
| first magnetic shield assembly | 40 | second magnetic shield assembly | 50 |
| first inner magnetic member | 41 | second inner magnetic member | 51 |
| second outer magnetic member | 52 | stop ring | 12 |
| open cavity | 61 | perforation | 62 |
| stopping cylinder | 63 | annular groove | 64 |
| annular stop | 65 | annular connection cylinder | 13 |
| damp ring | 70 | opening | 71 |
| annular accommodation groove | 14 | aperture | 15 |
| | | barrier strip | 16 |
| circuit board | 80 | annular step | 18 |
| accommodation groove | 17 | first inner magnetic end | 2211 |
| outer magnetic component | 221 | inner magnetic component | 211 |
| first outer magnetic end | 2212 | second outer magnetic end | 2112 |
| second inner magnetic end | 2111 | magnetic component | 20 |
| stiffener | 314 | | |
| first outer magnetic member | 42 | | |

DETAILED DESCRIPTION OF THE EMBODIMENTS

In order to make the purposes, technical solutions, and advantages of the present application clearer and more understandable, the present application will be further described in detail hereinafter with reference to the accompanying drawings and embodiments. It should be understood that the embodiments described herein are only intended to illustrate but not to limit the present application.

It is noted that when a component is referred to as being "fixed on" or "disposed on" another component, it can be directly on the other component, or it may be indirectly fixed or disposed on the other component. When a component is referred to as being "connected to" another component through a third component, it can be directly connected to the other component or it may be indirectly connected to the other component through the third component.

It should also be noted that, terms such as left, right, upper and lower, in this embodiment are merely relative concepts or are referenced to the normal use of the product, and should not be considered as restrictive.

Referring to FIG. 1 to FIG. 4, the present application provides a speaker, which comprises a horn bracket 1, a magnet system 2, and a vibration system 3. Wherein, the horn bracket 1 is provided with a through hole 11 for positioning the magnet system 2.

The magnet system 2 comprises an inner magnetic ring 21 and an outer magnetic ring 22 sleeved on an exterior of the inner magnetic ring 21, the inner magnetic ring 21 is coaxial with the outer magnetic ring 22, a gap 33 is provided between an inner annular surface of the outer magnetic ring 22 and an outer annular surface of the inner magnetic ring 21, wherein the inner annular surface and the outer annular surface have opposite magnetic polarities, and magnetic flux lines formed in the gap 33 by the outer magnetic ring 22 and the inner magnetic ring 21 are radially disposed, that is, radial magnetic flux lines are formed.

The vibration system 3 comprises a voice diaphragm 31, a voice coil 32 having one end connected to the voice diaphragm 31, and a winding 34 connected to another end of the voice coil 32, the winding 34 is disposed in the gap 33, and the voice diaphragm 31 is connected to one end of the horn bracket 1.

In the present embodiment, radial magnetic flux lines are formed in the gap 33 between the inner magnetic ring 21 and the outer magnetic ring 22 by radially magnetizing the inner magnetic ring 21 and the outer magnetic ring 22 under the action of the magnetizing device. The inner annular surface of the outer magnetic ring 22 and the outer annular surface of the inner magnetic ring 21 have opposite magnetic polarities. The outer annular surface of the inner magnetic ring 21 and the inner annular surface of the outer magnetic ring 22 are parallel to each other and parallel to the axis. As such, uniform and symmetrical radial magnetic flux lines are formed in the gap 33; that is, an annular radial magnetic field is formed. One end of the voice coil 32 is fixedly connected to the voice diaphragm 31, another end of the voice coil 32 is connected to the winding 34, the winding 34 receives the audio signal transmitted from the audio device, the winding 34 is inserted in the gap 33, and an electromagnetic induction is generated by varying signals inputted through the winding 34 and the uniform and symmetrical radial magnetic field in the gap 33. According to the principle of the left-hand rule, a drive force with different amplitudes and along the axis will be generated to ensure that the winding 34 can make a linear reciprocating motion in the radial magnetic field, thereby reducing the vibration of the vibration system 3 and ensuring the true reproduction of sound, thus converting electrical audio signals into sound signals. Furthermore, in the present embodiment, the design of the conventional pole core and the lower magnetic conducting plate is eliminated, and the design of the conductive plate of conventional low-carbon steel is replaced by the magnet. The speaker is normally applied to the headphone, but not limited to the headphone. The inner magnetic ring 21 and the outer magnetic ring 22 are magnetized by radial magnetization of the inner magnetic ring 21 and the outer magnetic ring 22, and uniform and symmetrical radial magnetic flux lines are formed in the gap 33 such that the voice coil 32 is only subjected to an axial force to drive the voice diaphragm 31 to vibrate to improve the authenticity of the audio effect output by the speaker, improving the user experience. Therefore, the design of the magnet system 2 reduces leakage and hysteresis losses, ensures uniform and symmetrical distribution of magnetic flux lines, reduces distortion, and realizes reproduction of true sound.

Further, the winding 34 is formed by winding a wire on the outer sidewall of one end of the voice coil 32, and an important parameter of the winding 34 is a winding amplitude indicating the width of the winding. In the present embodiment, the entire winding is placed in the gap 33.

In this present embodiment, the directions of the magnetic flux lines formed in the gap 33 by the inner magnetic ring 21 and the outer magnetic ring 22 are all directed to the ring center.

Further, the voice diaphragm 31 comprises a hollow inner ring diaphragm 311, an outer ring diaphragm 312, and a middle ring diaphragm 313 located between the inner ring diaphragm 311 and the outer ring diaphragm 312 and having a circular arc section. The outer ring diaphragm 312 is fixed on one end surface of the horn bracket 1, wherein, the middle ring diaphragm 313 has a circular arc opening facing the voice coil 32. In this way, the voice coil 32 can drive the middle ring diaphragm 313 to generate elastic deformation, which in turn causes the middle ring diaphragm 313 to vibrate, and by virtue of the middle ring diaphragm 313 having a circular arc shape and the hollow inner ring diaphragm 311, the deformation and vibration are realized and the audio signals are transmitted. The middle ring diaphragm 313 is provided on its surface facing the voice coil 32 with a plurality of stiffeners 314 that are in a strip shape and are distributed divergently and uniformly from the inner ring diaphragm 311 to the outer ring diaphragm 312, and one end of the voice coil 32 is fixed to the middle ring diaphragm 313. The stiffener 314 increases the rigidity of the voice diaphragm 31 as well as improves audio, thereby improving the quality of the product used to output the audio. The voice coil 32 is bonded to the surface of the middle ring diaphragm 313 through a high-temperature-resistant and strong-adhesion glue. An electromagnetic induction is generated by varying signals input through the winding 34 and the radial magnetic field in the gap 33. As a result, a drive force with different amplitudes and along the axis will be generated and driving the vibration system 3 reciprocates a linear motion, which will convert electrical audio signals into sound signals. The voice diaphragm 31 is formed by forming a single layer film of any new type of polymer material (such as Polyethylene terephthalate (PET), Polyether ether ketone (PEEK), Poly (ADP-ribose) (PAR) and Polyethylenimine (PEI), etc.) and adding a titanium coating to increase the rigidity of the voice diaphragm 31 and thereby extending the high frequency.

Further, the winding 34 is freely inserted into the gap 33, that is, there is also a gap between the winding 34 and the inner annular surface of the outer magnetic ring 22, and a gap between the inner surface of the insertion end of the voice coil 32 and the outer annular surface of the inner magnetic ring 21.

Further, as shown in FIG. 1 to FIG. 4, the outer magnetic ring 22 comprises a plurality of end-to-end outer magnetic components 221, each of the outer magnetic components 221 has a first inner magnetic end 2211 facing towards the ring center and a first outer magnetic end 2212 facing away from the ring center, the inner magnetic ring 21 comprises a plurality of end-to-end inner magnetic components 211, each of the inner magnetic components 211 is provided with a second inner magnetic end 2111 facing towards the ring center and a second outer magnetic end 2112 facing away from the ring center, the first inner magnetic end 2211 and the second outer magnetic end 2112 have opposite magnetic polarities.

Magnetizing each inner magnetic component 211 and each outer magnetic component 221 by a magnetizing device to generate uniform magnetic flux lines respectively, a plurality of inner magnetic components 211 are connected end-to-end to form the inner magnetic ring 21, and a plurality of outer magnetic components 221 are connected end-to-end to form the outer magnetic ring 22. In this embodiment, the side faces of the two adjacent inner magnetic components 211 are butted, and similarly, the side faces of the two adjacent outer magnetic components 221 are butted, by analogy, a plurality of inner magnetic components 211 are butted to form the inner magnetic ring 21, and a plurality of outer magnetic components 221 are butted to form the outer magnetic ring 22, such that the outer annular surface of the inner magnetic ring 21 and the inner annular surface of the outer magnetic ring 22 have opposite magnetic polarities. The design of the magnet system 2 reduces leakage and hysteresis losses, ensures even uniform and symmetrical distribution of magnetic flux lines, reduces distortion, and realizes reproduction of true sound. In the meantime, ensure that the winding 34 can make a linear reciprocating motion in the radial magnetic field, thereby reducing the vibration of the vibration system 3 and ensuring the true reproduction of sound, thereby converting electrical audio signals into sound signals.

Further, as shown in FIG. 1 to FIG. 4, if the number of the outer magnetic components 221 is N, and the number of the inner magnetic components 211 is M, then N=M, and the N outer magnetic components 221 and the M inner magnetic components 211 are arranged in a one-to-one correspondence. The arrangement is such that the first inner magnetic end 2211 of the outer magnetic component 221 may face the second outer magnetic end 2112 of the inner magnetic component 211 and be parallel to each other, as a result, the uniformity of magnetic flux lines in the gap 33 between the two components will not be affected due to the butting gap, and the magnetic flux lines in the gap 33 are evenly distributed and more reliable.

Figure 3:
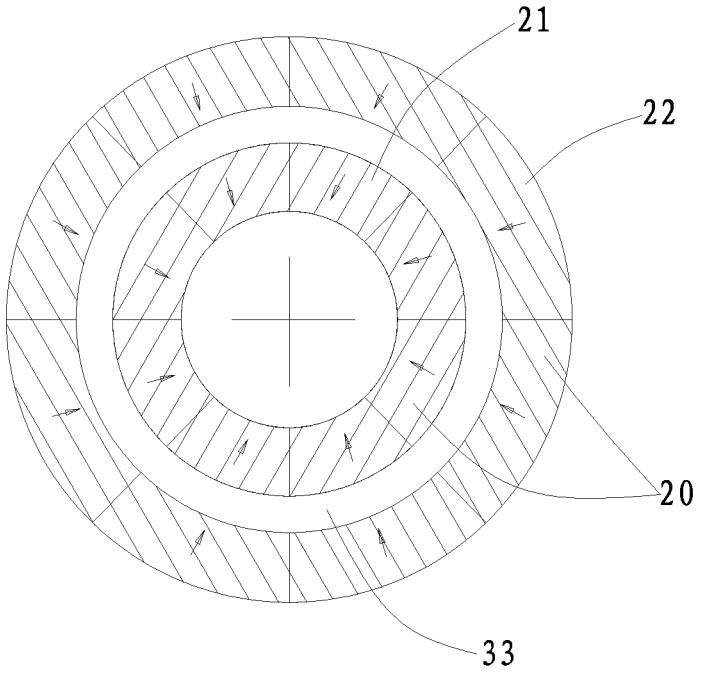
FIG. 3 is a radial cross-sectional view of an inner magnetic ring and an outer magnetic ring according to one embodiment of the present application.
Figure 4:
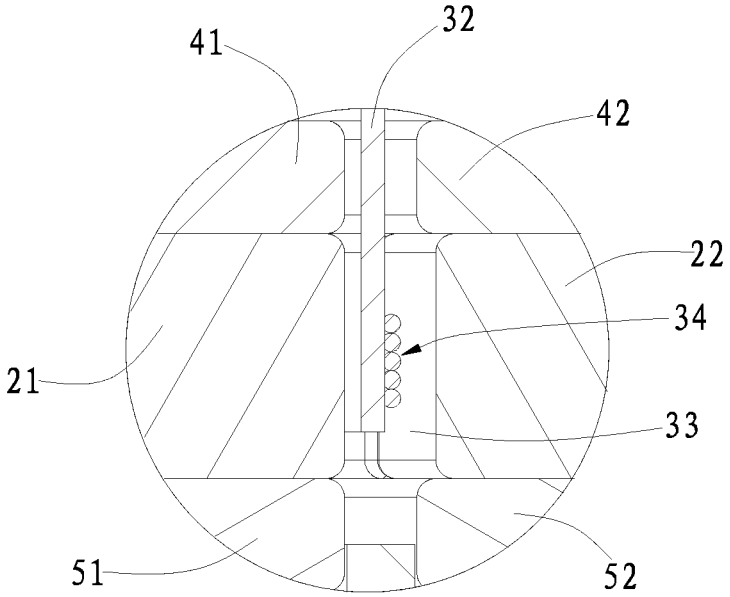
FIG. 4 is an enlarged view of a portion E in FIG. 2.

Further, please refer to FIG. 1 and FIG. 3 together, each of the outer magnetic components 221 and each of the inner magnetic components 211 have a fan-shaped or rectangular cross-section, or alternatively each of the outer magnetic components 221 and each of the inner magnetic components 211 are in a columnar shape.

In this embodiment, the cross section of each magnetic component 20 is fan-shaped.

Further, as shown in FIG. 1 to FIG. 4, the magnet system 2 further comprises a magnetic shield assembly, the magnetic shield assembly comprises a first magnetic shield assembly 40 disposed on one side of the inner magnetic ring 21 and the outer magnetic ring 22 and directly opposite to the voice diaphragm 31, and a second magnetic shield assembly 50 disposed on the other side of the inner magnetic ring 21 and the outer magnetic ring 22. The first magnetic shield assembly 40 comprises a first inner magnetic member 41 in an annular shape and fixed to one side of the inner magnetic ring 21, and a first outer magnetic member 42 sleeved on the exterior of the first inner magnetic member 41 and fixed to one side of the outer magnetic ring 22, and both the side face of the first outer magnetic member 42 and the side face the first inner magnetic member 41, facing towards the voice diaphragm 31, have opposite magnetic polarities and form a closed first annular magnetic circuit therebetween. The second magnetic shield assembly 50 comprises a second inner magnetic member 51 in an annular shape and fixed to the other side of the inner magnetic ring 21, and a second outer magnetic member 52 sleeved on the exterior of the second inner magnetic member 51 and fixed to the other side of the outer magnetic ring 22, and both the side face of the second inner magnetic member 51 and the side face of the second outer magnetic member 52, facing away from the voice diaphragm 31, have opposite magnetic polarities and form a closed second annular magnetic circuit therebetween.

In this embodiment, both the first annular magnetic circuit and the second annular magnetic circuit are closed annular magnetic circuits, and the closed annular magnetic circuits are disposed on both sides of the inner magnetic ring 21 or the outer magnetic ring 22. The annular magnetic circuits can effectively prevent external electromagnetic interference to uniform radial magnetic flux lines, thereby further improving the quality of the product for outputting audio. With this magnetic shielding component, the low flux leakage of the magnetic circuit of the magnet system 2 and the symmetry of magnetic flux lines are further ensured, and the use of a plurality of radially magnetized magnetic components 20 constituting the inner magnetic ring 21 and the outer magnetic ring 22 mainly ensures the uniformity and symmetry of the magnetic flux lines, and ensures that the vibration system 3 can make a linear reciprocating motion in the magnetic circuit, thereby reducing the vibration of the vibration system 3 and ensuring the true reproduction of sound. In the meantime, the design of the conventional pole core and the lower magnetic conducting plate is eliminated, and the design of the conductive plate of conventional low-carbon steel is replaced by the magnet.

Further, the first inner magnetic member 41 and the second inner magnetic member 51 are respectively attached to two opposite sides of the inner magnetic ring 21, and the first outer magnetic member 42 and the second outer magnetic member 52 are respectively adhered to two opposite sides of the outer magnetic ring 22.

In this embodiment, the first inner magnetic member 41, the first outer magnetic member 42, the second inner magnetic member 51 and the second outer magnetic member 52 are annular magnets.

Preferably, as shown in FIG. 1 to FIG. 4, side faces of the first inner magnetic member 41 and the second inner magnetic member 51, facing the inner magnetic ring 21, have the same magnetic polarity as the outer annular surface of the inner magnetic ring 21, and side faces of the first outer magnetic member 42 and the second outer magnetic member 52, facing the outer magnetic ring 22, have the same magnetic polarity as the inner annular surface of the outer magnetic ring 22.

In this embodiment, the first magnetic shield assembly 40 and the second magnetic shield assembly 50 are not only capable of forming annular magnetic circuits to resist external electromagnetic interference, but also magnetizing the inner magnetic ring 21 and the outer magnetic ring 22, enhancing the magnetic of the inner magnetic ring 21 and the outer magnetic ring 22, avoiding the flux leakage of the inner magnetic ring 21 and the outer magnetic ring 22, or avoiding affecting the transmission quality of the audio due to the magnetic decay caused by longer use time.

Figure 2:
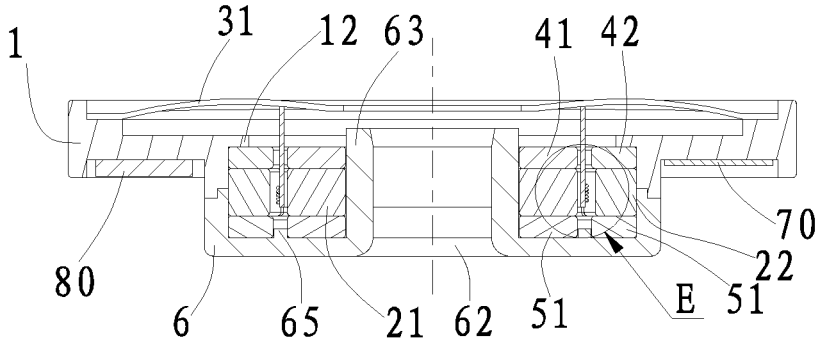
FIG. 2 is a cross-sectional view along with the middle line A-A in FIG. 1.
Figure 5:
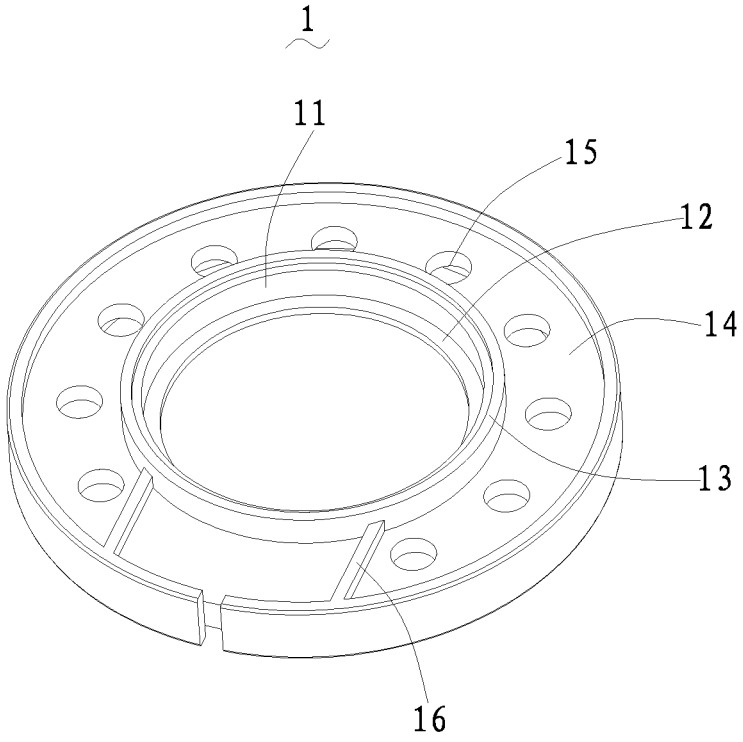
FIG. 5 is a perspective view of a horn bracket according to one embodiment of the present application.

Further, please refer to FIG. 2 and FIG. 5 together, the horn bracket 1 is provided in a wall of the through hole 11 with a stop ring 12 configured for limiting the displacement of the first outer magnetic member 42 toward the voice diaphragm 31, the stop ring 12 is located at a port of the through hole 11 that is facing towards the voice diaphragm 31 and used for axial position-limiting of the first outer magnetic member 42.

In this embodiment, the stop ring 12 is disposed circumferentially along the inner wall of the through hole 11. The arrangement is not limited thereto, as long as the first outer magnetic member 42 can be stopped.

Figure 7:
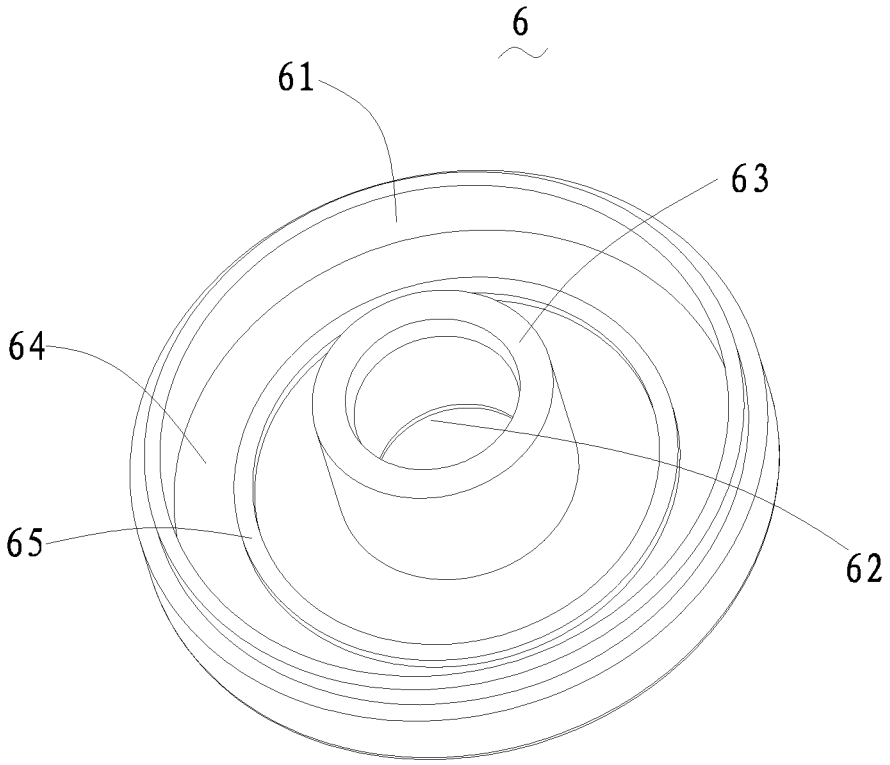
FIG. 7 is a perspective view of a U-shaped cup according to one embodiment of the present application.

Further, as shown in FIG. 1, FIG. 2 and FIG. 7 together, the speaker further comprises a U-shaped cup 6, which is fixed to an end of the horn bracket 1 facing away from the voice diaphragm 31, the U-shaped cup 6 is provided with an open cavity 61, a base wall of the open cavity 61 is provided with a perforation 62 in communication with the through hole 11, and the second inner magnetic member 51 and the second outer magnetic member 52 are fixed to the base wall of the open cavity 61.

Further, perforation 62 has a diameter ranged from 4 millimeters (mm) to 12 mm.

Further, as shown in FIG. 1, FIG. 2, and FIG. 7 together, the base wall of the open cavity 61 is located at the outer edge of the perforation 62, and surrounds the perforation 62, and is provided with a stopping cylinder 63 protruding toward the voice diaphragm 31, and the outer sidewall of the stopping cylinder 63, the base wall and a side wall of the open cavity 61 together form an annular groove 64 with a U-shaped cross section, and the magnet system 2 is fixed within the annular groove 64.

Further, as shown in FIG. 1, FIG. 2, FIG. 4, and FIG. 7 together, the base wall of the open cavity 61 is provided with an annular stop 65 protruding toward the gap 33, and the second outer magnetic member 52 and the second inner magnetic member 51 are respectively disposed on both sides of the annular stop 65, which is used to separate the second outer magnetic member 52 from the second inner magnetic member 51 so as to prevent the second outer magnetic member 52 from being held together with the second inner magnetic member 51 due to the magnetic attraction and affecting the normal operation of the magnet system 2.

Further, as shown in FIG. 1, FIG. 2, FIG. 5, and FIG. 7 together, the horn bracket 1 is provided with an annular connection cylinder 13 protruding toward the U-shaped cup 6, the annular connection cylinder 13 is arranged on an end surface of the horn bracket 1 which is directly facing the U-shaped cup 6 and surrounding an edge of an end opening of the through hole 11, an end surface of the annular connection cylinder 13 and an end surface of an open end of the U-shaped cup 6 are butted by an ultrasonic welding process, achieving the sealing connection between the U-shaped cup 6 and the end surface of the annular connection cylinder 13, avoiding dust and liquid entering the annular groove 64 and affecting the normal work of the magnet system 2.

Further, the end surface where the annular connection cylinder 13 is connected to the U-shaped cup 6 is stepped. Correspondingly, the end surface where the U-shaped cup 6 is connected to the annular connection cylinder 13 is also stepped, and matches the shape of the end surface of the annular connection cylinder 13.

Further, please refer to FIG. 1, FIG. 2, and FIG. 5 together, the speaker further comprises a damp ring 70 with an opening 71, the horn bracket 1 is provided, in a surface facing away from the voice diaphragm 31 with an annular accommodation groove 14 configured for accommodating the damp ring 70, and a bottom wall of the annular accommodation groove 14 faces the damp ring 70 and is provided with a plurality of apertures 15 toward the voice diaphragm 31.

Further, the annular accommodation groove 14 is formed around the annular connection cylinder 13, and the damp ring 70 is covered on the plurality of apertures 15 to provide the function of reducing the noise and vibration.

Further, please refer to FIG. 1, FIG. 2, and FIG. 5 together, the speaker further comprises a circuit board 80 connected with the output line of an audio device, the winding 34 is connected with the circuit board 80 to realize the transmission of the audio signal, the annular accommodation groove 14 is provided with two barrier strips 16 protruding from the bottom wall facing the opening 71 of the damp ring 70, and the circuit board is fixed between the two barrier strips 16.

Figure 6:
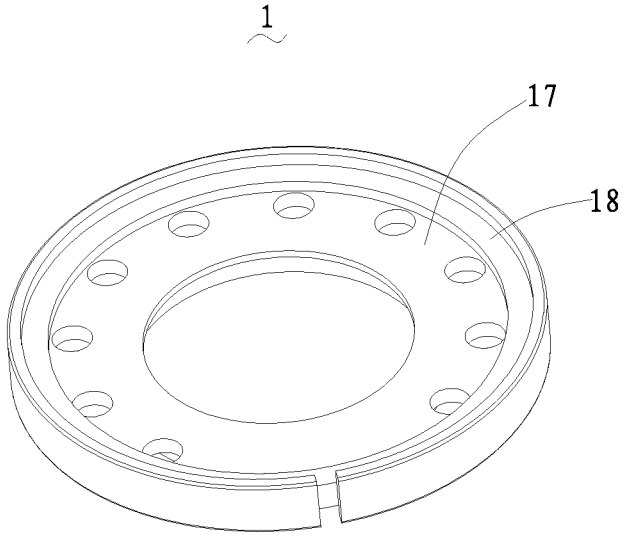
FIG. 6 is a perspective view of the back of the horn bracket in FIG. 5.

Further, as shown in FIG. 6, the horn bracket 1 is provided with an accommodation groove 17 recessed in an end surface facing the voice diaphragm 31, the accommodation groove 17 is provided with an annular step 18 at a junction of a groove bottom and a groove wall thereof, an outer edge of the voice diaphragm 31 is fixed on the stepped surface of the annular step 18.

Further, referring to FIG. 1, FIG. 2, and FIG. 6, the outer ring diaphragm 312 of the voice diaphragm 31 is fixed on the stepped surface of the annular step 18.

In summary, in this embodiment, referring to FIG. 1 to FIG. 7 together, the voice diaphragm 31, the voice coil 32, the horn bracket 1, the inner magnetic ring 21, the outer magnetic ring 22, the first inner magnetic member 41, the first outer magnetic member 42, the second inner magnetic member 51, the second outer magnetic member 52 and the U-shaped cup 6 have the same axis, and the central holes of the voice diaphragm 31, the voice coil 32, the horn bracket 1, the inner magnetic ring 21, the first inner magnetic member 41, the second inner magnetic member 51 and the U-shaped cup 6 all communicate with each other and are coaxial.

Please refer to FIG. 1 to FIG. 4 together, the present application further provides a headphone, comprising a housing, an above-mentioned speaker disposed in the housing, and a connection wire configured for connection with an audio device and transmission of audio signal, the connection wire is in electrical connection with the winding 34.

In this embodiment, the above-mentioned speaker is applied to the headphone, the inner magnetic ring 21 and the outer magnetic ring 22 are magnetized by radial magnetization for the inner magnetic ring 21 and the outer magnetic ring 22, and uniform and symmetrical radial magnetic flux lines are formed in the gap 33 such that the voice coil 32 is only subjected to an axial force, such that the voice diaphragm 31 is driven to vibrate, the authenticity effect of the audio output through the headphone is improved, and the user experience of the headphone is improved.

Furthermore, the directions of the magnetic flux lines formed in the gap 33 by the outer magnetic components 221 and the inner magnetic components 211 are all directed to the ring center. The first annular magnetic circuit is formed by the first inner magnetic member 41 and the first outer magnetic member 42, and the second annular magnetic circuit is formed by the second inner magnetic member 51 and the second outer magnetic member 52, wherein both the first annular magnetic circuit and the second annular magnetic circuit are closed annular magnetic circuits, which are respectively disposed on both sides of the inner magnetic ring 21 and the outer magnetic ring 22, such that the above-identified magnetic flux lines, which are directed to the ring center, formed between the outer magnetic components 221 and the inner magnetic components 211 can be disposed and protected between the first closed annular magnetic circuit and the second closed annular magnetic circuit, the closed annular magnetic circuits can effectively prevent external electromagnetic interference to uniform radial magnetic flux lines, thereby further improving the quality of the product for outputting audio.

The aforementioned embodiments are only preferred embodiments of the present application, and are not intended for limiting the present application. Any modification, equivalent replacement, improvement, and so on, which are made within the spirit and the principle of the present application, should be included in the protection scope of the present application.

What is claimed is:

1. An apparatus, comprising:

a magnet system comprising:

an inner magnetic ring;

an outer magnetic ring sleeved on an exterior of the inner magnetic ring, wherein the inner magnetic ring is coaxial with the outer magnetic ring, wherein a gap is provided between an inner annular surface of the outer magnetic ring and an outer annular surface of the inner magnetic ring, wherein the inner annular surface and the outer annular surface have opposite magnetic polarities, and wherein magnetic flux lines formed in the gap by the outer magnetic ring and the inner magnetic ring are radially disposed; and a magnetic shield assembly comprising a first magnetic shield assembly disposed on one side of the inner magnetic ring and the outer magnetic ring and a second magnetic shield assembly disposed on another side of the inner magnetic ring and the outer magnetic ring;

a horn bracket coupled to the magnet system and comprising a through hole configured to position the magnet system; and a vibration system coupled to the horn bracket and comprising:

a voice diaphragm coupled to an end of the horn bracket;

a voice coil; and a winding disposed in the gap, wherein the voice diaphragm and the winding are respectively disposed at two ends of the voice coil.

2. The apparatus of claim 1, wherein the outer magnetic ring comprises a plurality of end-to-end outer magnetic components, wherein each of the end-to-end outer magnetic components has a first inner magnetic end configured to face towards a ring center and a first outer magnetic end configured to face away from the ring center, wherein the inner magnetic ring comprises a plurality of end-to-end inner magnetic components, wherein each of the end-to-end inner magnetic components comprises a second inner magnetic end configured to face towards the ring center and a second outer magnetic end configured to face away from the ring center, and wherein the first inner magnetic end and the second outer magnetic end have opposite magnetic polarities.

3. The apparatus of claim 2, wherein a number of the end-to-end outer magnetic components is N and a number of the end-to-end inner magnetic components is M, wherein N=M, and wherein the N end-to-end outer magnetic components and the M end-to-end inner magnetic components are arranged in a one-to-one correspondence.

4. The apparatus of claim 2, wherein each of the end-to-end outer magnetic components and each of the end-to-end inner magnetic components have a fan-shaped or rectangular cross-section, or wherein each of the end-to-end outer magnetic components and each of the end-to-end inner magnetic components are in a columnar shape.

5. The apparatus of claim 1, wherein the first magnetic shield assembly comprises:

a first inner magnetic member in an annular shape and coupled to one side of the inner magnetic ring; and a first outer magnetic member sleeved on an exterior of the first inner magnetic member and coupled to one side of the outer magnetic ring, wherein both a side face of the first outer magnetic member and a side face of the first inner magnetic member, facing towards the voice diaphragm are configured to:

comprise opposite magnetic polarities; and form a closed first annular magnetic circuit therebetween, and wherein the second magnetic shield assembly comprises:

a second inner magnetic member in the annular shape and coupled to the other side of the inner magnetic ring; and a second outer magnetic member sleeved on an exterior of the second inner magnetic member and coupled to the other side of the outer magnetic ring, wherein both a side face of the second inner magnetic member and a side face of the second outer magnetic member facing away from the voice diaphragm are configured to:

comprise opposite magnetic polarities; and form a closed second annular magnetic circuit therebetween.

6. The apparatus of claim 5, wherein side faces of the first inner magnetic member and of the second inner magnetic member, facing the inner magnetic ring are configured to have a same magnetic polarity as the outer annular surface of the inner magnetic ring, and wherein side faces of the first outer magnetic member and of the second outer magnetic member, facing the outer magnetic ring are configured to have the same magnetic polarity as the inner annular surface of the outer magnetic ring.

7. The apparatus of claim 5, wherein the horn bracket is provided in a wall of the through hole with a stop ring configured to limit a displacement of the first outer magnetic member towards the voice diaphragm, and wherein the stop ring is located at a port of the through hole facing towards the voice diaphragm.

8. The apparatus of claim 5, wherein the horn bracket further comprises a U-shaped cup coupled to an end of the horn bracket facing away from the voice diaphragm, wherein the U-shaped cup comprises an open cavity, wherein a base wall of the open cavity comprises a perforation in communication with the through hole, and wherein the second inner magnetic member and the second outer magnetic member are coupled to the base wall of the open cavity.

9. The apparatus of claim 8, wherein the base wall of the open cavity is located at an outer edge of the perforation surrounding the perforation and comprises a stopping cylinder protruding towards the voice diaphragm, wherein an outer sidewall of the stopping cylinder, the base wall and a side wall of the open cavity together are configured to form an annular groove with a U-shaped cross section, and wherein the magnet system is coupled within the annular groove.

10. The apparatus of claim 8, wherein the base wall of the open cavity comprises an annular stop protruding towards the gap, and wherein the second outer magnetic member and the second inner magnetic member are respectively disposed on both sides of the annular stop.

11. The apparatus of claim 8, wherein the horn bracket further comprises an annular coupling cylinder protruding towards the U-shaped cup, wherein the annular coupling cylinder is arranged on an end surface of the horn bracket which is directly facing towards the U-shaped cup and surrounding an edge of an end opening of the through hole, and wherein an end surface of the annular coupling cylinder and an end surface of an open end of the U-shaped cup are coupled by an ultrasonic welding process.

12. The apparatus of claim 1, wherein the horn bracket further comprises a damp ring with an opening, wherein the horn bracket is provided in a surface facing away from the voice diaphragm with an annular accommodation groove configured to accommodate the damp ring, and wherein a bottom wall of the annular accommodation groove is configured to face the damp ring and comprises a plurality of apertures toward the voice diaphragm.

13. The apparatus of claim 12, wherein the horn bracket further comprises a circuit board coupled to an output line of an audio device, wherein the winding is coupled to the circuit board to realize a transmission of an audio signal, wherein the annular accommodation groove comprises two barrier strips protruding from the bottom wall facing the opening of the damp ring, and wherein the circuit board is coupled between the two barrier strips.

14. The apparatus of claim 1, wherein the horn bracket further comprises an accommodation groove recessed in an end surface facing the voice diaphragm, wherein the accommodation groove comprises an annular step at a junction of a groove bottom and a groove wall thereof, and wherein an outer edge of the voice diaphragm is coupled to a stepped surface of the annular step.

15. A headphone, comprising:

a housing;

an apparatus disposed in the housing, wherein the apparatus comprises:

a magnet system comprising:

an inner magnetic ring;

an outer magnetic ring sleeved on an exterior of the inner magnetic ring, wherein the inner magnetic ring is coaxial with the outer magnetic ring, wherein a gap is provided between an inner annular surface of the outer magnetic ring and an outer annular surface of the inner magnetic ring, wherein the inner annular surface and the outer annular surface have opposite magnetic polarities, and wherein magnetic flux lines formed in the gap by the outer magnetic ring and the inner magnetic ring are radially disposed; and a magnetic shield assembly comprising a first magnetic shield assembly disposed on one side of the inner magnetic ring and the outer magnetic ring and a second magnetic shield assembly disposed on another side of the inner magnetic ring and the outer magnetic ring;

a horn bracket coupled to the magnet system and comprising a through hole configured to position the magnet system; and a vibration system coupled to the horn bracket and comprising:

a voice diaphragm coupled to an end of the horn bracket;

a voice coil; and a winding disposed in the gap, and wherein the voice diaphragm and the winding are respectively disposed at two ends of the voice coil; and a coupling wire in an electrical coupling with the winding and configured to:

couple an audio device; and transmit an audio signal.

16. The headphone of claim 15, wherein the outer magnetic ring comprises a plurality of end-to-end outer magnetic components, wherein each of the end-to-end outer magnetic components has a first inner magnetic end configured to face towards a ring center and a first outer magnetic end configured to face away from the ring center, wherein the inner magnetic ring comprises a plurality of end-to-end inner magnetic components, wherein each of the end-to-end inner magnetic components comprises a second inner magnetic end configured to face towards the ring center and a second outer magnetic end configured to face away from the ring center, and wherein the first inner magnetic end and the second outer magnetic end have opposite magnetic polarities.

17. The headphone of claim 15, wherein the first magnetic shield assembly comprises:

a first inner magnetic member in an annular shape and coupled to one side of the inner magnetic ring; and a first outer magnetic member sleeved on an exterior of the first inner magnetic member and coupled to one side of the outer magnetic ring, wherein both a side face of the first outer magnetic member and a side face of the first inner magnetic member, facing towards the voice diaphragm are configured to:

comprise opposite magnetic polarities; and form a closed first annular magnetic circuit therebetween, and wherein the second magnetic shield assembly comprises:

a second inner magnetic member in the annular shape and coupled to the other side of the inner magnetic ring; and a second outer magnetic member sleeved on the exterior of the second inner magnetic member and coupled to the other side of the outer magnetic ring, wherein both a side face of the second inner magnetic member and a side face of the second outer magnetic member, facing away from the voice diaphragm are configured to:

comprise opposite magnetic polarities; and form a closed second annular magnetic circuit therebetween.

18. The headphone of claim 17, wherein side faces of the first inner magnetic member and of the second inner magnetic member, facing the inner magnetic ring are configured to have a same magnetic polarity as the outer annular surface of the inner magnetic ring, and wherein side faces of the first outer magnetic member and of the second outer magnetic member, facing the outer magnetic ring are configured to have the same magnetic polarity as the inner annular surface of the outer magnetic ring.

19. The headphone of claim 17, wherein the horn bracket is provided in a wall of the through hole with a stop ring configured to limit a displacement of the first outer magnetic member towards the voice diaphragm, and wherein the stop ring is located at a port of the through hole facing towards the voice diaphragm.

20. The headphone of claim 17, wherein the horn bracket further comprises a U-shaped cup coupled to an end of the horn bracket facing away from the voice diaphragm, wherein the U-shaped cup comprises an open cavity, wherein a base wall of the open cavity comprises a perforation in communication with the through hole, and wherein the second inner magnetic member and the second outer magnetic member are coupled to the base wall of the open cavity.

* * * * *